US007365637B2

(12) United States Patent
Claiborne

(10) Patent No.: US 7,365,637 B2
(45) Date of Patent: Apr. 29, 2008

(54) REVERSIBLE DIODE DOORBELL DETECTION CIRCUIT

(75) Inventor: Jimmy D. Claiborne, Scottsville, KY (US)

(73) Assignee: Heathco LLC, Elmhurst, IL (US)

( * ) Notice: Subject to any disclaimer, the term of this patent is extended or adjusted under 35 U.S.C. 154(b) by 290 days.

(21) Appl. No.: 11/155,759

(22) Filed: Jun. 17, 2005

(65) Prior Publication Data

US 2007/0008077 A1 Jan. 11, 2007

(51) Int. Cl.
*G08B 5/00* (2006.01)

(52) U.S. Cl. ..... 340/330; 340/328; 340/393.3

(58) Field of Classification Search ..... 340/330, 340/513, 328, 384.1, 392.1, 393.3; 379/167.05
See application file for complete search history.

(56) References Cited

U.S. PATENT DOCUMENTS 3,603,949 A 9/1971 Walthard ..... 340/214
3,624,646 A 11/1971 Weiss ..... 340/371
3,739,376 A 6/1973 Keledy ..... 340/224
4,567,471 A 1/1986 Acar ..... 340/531
5,680,102 A * 10/1997 Xydis ..... 340/539.16
5,894,262 A 4/1999 McCavit et al. ..... 340/328
6,759,955 B2 * 7/2004 Koneff et al. ..... 340/539.1

* cited by examiner

*Primary Examiner*—Phung T. Nguyen
(74) *Attorney, Agent, or Firm*—Fitch, Even, Tabin & Flannery

(57) ABSTRACT

A doorbell detection and playback circuit for a doorbell pushbutton connected to an alternating current power source comprises at least one bridge rectifier circuit coupled to the power source through a diode placed in parallel with the pushbutton. The bridge rectifier circuit generates a signal at a first frequency when the pushbutton is not depressed, and generates a signal at a second frequency when the pushbutton is depressed. A frequency detection circuit is included and is coupled to the signal from the bridge rectifier. The frequency detection circuit further comprises an output responsive to the presence of a signal at the second frequency coupled to a sound generator for playing a ring tone or series thereof.

10 Claims, 1 Drawing Sheet

REVERSIBLE DIODE DOORBELL DETECTION CIRCUIT

BACKGROUND OF THE INVENTION

1. Field of the Invention

Figure 1:
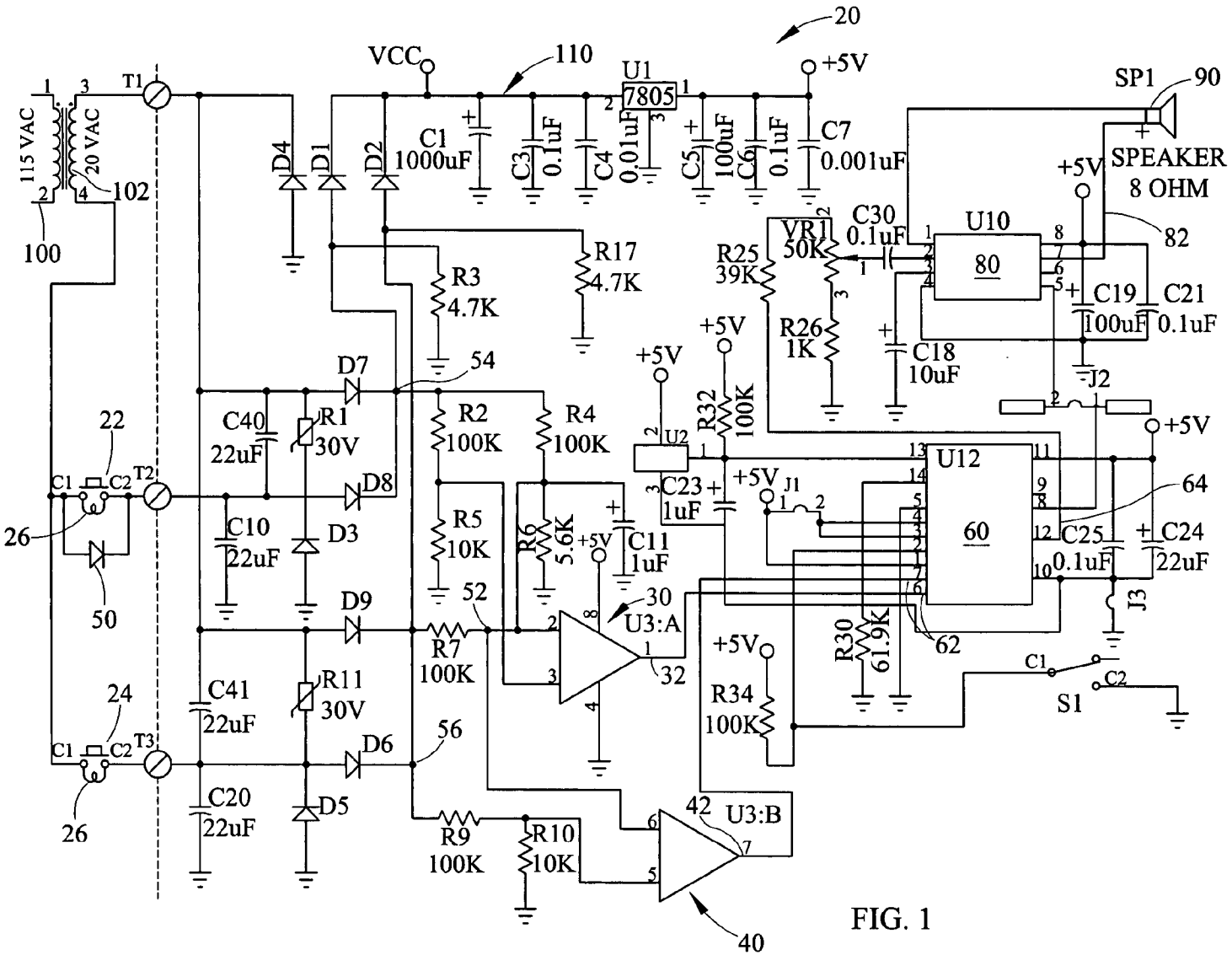

The present invention relates generally to an electronic doorbell chime circuit and more particularly to an electronic doorbell chime circuit that is capable of operating with more than one pushbutton or doorbell switch and detect which pushbutton is being depressed based on the presence or absence of signal generated through a diode placed in parallel with one of the doorbell pushbuttons.

2. Description of the Related Art

Electronic doorbell circuits come in many varieties and are generally known in the art. Many prior art electronic doorbell circuits utilize a conventional power source, such as widely available 120 VAC power coupled to a transformer for stepping down the AC power to a lower voltage, for example 16, 20 or 24 volts. The secondary winding of the transformer is typically electrically coupled to at least one doorbell switch and a concomitant detector circuit for determining when the doorbell switch has been depressed, thereby initiating the broadcast of a ring tone. In systems employing multiple doorbell switches, it is known to enable the detector circuit to distinguish between a plurality of doorbells, thereby enabling the broadcast of different ring tones for different doorbell locations.

In some known doorbell pushbutton detection circuits, a diode is connected in parallel across one of the doorbell switches as a component of a power supply circuit for the detection circuitry. In some of these known systems, the polarity of the diode becomes critical to the proper functioning of the circuit, thereby requiring an installer to properly orient the diode in order to permit the detection circuit to operate. Often this is a particularly acute problem for systems purchased for installation by homeowners, since they lack the requisite knowledge of electricity and electronics necessary to properly orient the diode.

Other prior art systems have obviated this problem by providing detection circuitry that functions regardless of the orientation of the diode placed in parallel with one of the pushbuttons. For example, U.S. Pat. No. 5,894,262 to McCavit et al., incorporated herein by reference, teaches an electronic doorbell detection circuit that is insensitive to the polarity of the diode, and utilizes a comparator circuit to detect a threshold voltage indicative of pushbutton depression. However, systems such as these utilizing a plurality of doorbell pushbuttons require a plurality of threshold voltages to be detected so that the system is capable of determining which doorbell is being depressed. This, in turn, requires the use of a plurality of comparator circuits or the like to detect voltages at certain threshold levels to determine pushbutton operation.

SUMMARY OF THE INVENTION

The present invention overcomes the aforementioned problems by providing an electronic doorbell pushbutton detection circuit that produces signals having differing frequencies responsive to the depression or actuation of a doorbell pushbutton. The invention includes a plurality of full-wave bridge rectification circuits coupled to the secondary winding of a step-down transformer to produce signals responsive to a plurality of doorbell pushbuttons.

One pushbutton includes a diode in parallel with the pushbutton that operates to produce a half-wave output signal when the pushbutton is not depressed. In contradistinction, when depressed, the pushbutton produces a full wave output signal. In one embodiment of the invention, a plurality of amplifier circuits are electrically coupled to a plurality of pushbutton output signals, which are provided to a microprocessor having a plurality of pulse counter inputs. When the microprocessor senses a signal greater than a predetermined frequency threshold at one of the pulse counter inputs, it determines that a particular pushbutton has been depressed and supplies an audio output to an audio amplifier circuit to play a selected ring tone through a speaker.

The present invention may additionally incorporate an alternative output, or a plurality thereof, to actuate a variety of indicator devices such as a mechanical vibratory device, a pager, or an optical indicator such as a light or strobe to indicate the depression of the doorbell pushbutton.

The present invention is suitable for use in applications where a plurality of pushbuttons are required, since a plurality of frequencies may be easily detected by the pulse counter inputs of the microprocessor without the necessity of supplying additional circuit components. Other features, objects, and advantages of the invention will become apparent from the detailed description of the preferred embodiments, taken in conjunction with the drawing figures herein below.

BRIEF DESCRIPTION OF THE DRAWING FIGURES

FIG. 1 is an exemplary circuit diagram of a doorbell detection and playback circuit in accordance with one embodiment of the present invention.

DETAILED DESCRIPTION OF THE PREFERRED EMBODIMENT(S)

Referring now to FIG. 1, and in accordance with a preferred constructed embodiment of the present invention, an electronic doorbell detection circuit 20 is shown here in one embodiment utilizing two doorbell pushbuttons or switches 22, 24. Each of the switches 22, 24 is electrically coupled to a differential amplifier circuit, denoted generally by reference numerals 30 and 40 respectively. The amplifier circuits 30, 40 each have an output 32, 42 electrically coupled to an input of a microprocessor 60 having a plurality of pulse counter inputs 62 for determining the frequency of the signal supplied to input 62.

Furthermore, microprocessor 60 includes an audio output 64 coupled to an input of an audio amplifier 80, that in turn supplies an output 82 to a conventional loudspeaker 90 to broadcast a sound responsive to the depression of one of the doorbell pushbutton 22, 24 as will be discussed in greater detail herein below. In accordance with one embodiment of the present invention, an HT 82V733 model supplied by Holtek Semiconductors Inc. of Taiwan may be employed as an audio amplifier 80. One of ordinary skill in the art will recognize that an output of microprocessor 60 can be employed to activate a wide variety of indicator devices to alert an occupant to the actuation of the doorbell pushbutton including but not limited to lights, pagers, buzzers and audible tone generators.

Electrical power is provided to the doorbell detection circuit 20 via a transformer 100 having a single primary and a single secondary winding 102. As shown in FIG. 1, transformer 100 converts 120VAC electrical power to, for example, 20 VAC power for use in conjunction with the circuit 20 of the present invention. Additionally, a DC power supply circuit, denoted generally by reference numeral 110, is supplied to provide DC power to microprocessor 60 and audio amplifier 80, as well as their ancillary components.

A diode 50 is electrically connected in parallel with one pushbutton 22, 24, the orientation of the diode being irrelevant to the operation of the circuit, as will be discussed further herein below. Although the diode 50 is shown in FIG. 1 in parallel with pushbutton 22, it may instead be located in parallel with pushbutton 24. This feature of the present invention is particularly advantageous since it permits installation of the diode at either pushbutton 22, 24, without regard to polarity, by a consumer or end-user who may lack the knowledge or facility to properly orient the diode 50. Diode 50 is used to supply half-wave rectified power as an input to amplifier 30 of detector circuit 20.

A plurality of four-way bridge rectifiers are incorporated in circuit 20, formed by diodes D4 and D3 (providing paths to ground) and the diode pair D7/D8 and also by diodes D4 and D5 and the diode pair D6/D9. In other words, diodes D4, D3, D7, and D8 form one bridge rectifier, while diodes D4, D5, D6 and D9 form another. Accordingly, either a positive or negative AC signal applied to either of the bridge rectifiers via the secondary coil of transformer 100 will produce a positive output signal so that the detector circuit 20 will function regardless of the orientation of diode 50 connected in parallel across one of the doorbell switches 22, 24.

The doorbell switches 22, 24 include an incandescent lamp 26 or other equivalent light source to illuminate the area proximate the switch to enable an entrant to locate the button and/or a door key. These lamps 26 are provided with continuous AC power via capacitors C40 and C41 respectively. Capacitors C40 and C41 in conjunction with capacitors C10 and C20 also operate to shape the input signals from pushbuttons 22,24 at terminals T2 and T3 respectively, pulling the signals low when diode 50 is reverse biased.

A common input signal at node 52 is applied to the inverting inputs of differential amplifier circuits 30, 40, each signal reduced in amplitude by voltage dividing resistor pair R4 and R6. This input signal at node 52 is provided as a threshold voltage for differential amplifiers 30 and 40, and is generated through diodes D7 and D9 respectively, which provide either a half-wave rectified signal or a full wave rectified signal at node 52 depending upon which pushbutton is being depressed. The threshold voltage amplitude is determined by the value of voltage dividing resistors R4 and R6.

When pushbutton 22 is not depressed, diode 50 is forward biased during approximately one-half of the AC power cycle produced by the secondary winding 102 of transformer 100, thereby providing a half-wave rectified signal through diode D8 and voltage divider R2/R5 to non-inverting input 3 of amplifier circuit 30. While pushbutton 22 remains open (not depressed) the presence of diode 50 prevents diode D3 from conducting back through terminal T2 to transformer 100, thereby preventing a signal at node 54 through diode D7 during the entire AC power cycle. Accordingly, while pushbutton 22 remains open, the input signal coupled to the non-inverting input pin 3 of differential amplifier circuit 30 is a 60 cycle, or half-wave rectified signal.

When pushbutton 22 is depressed, diode D3 becomes forward biased during approximately one-half of the power cycle and conducts through terminal T2 and pushbutton 22 back to transformer 100 during one-half of the power cycle, so that a full-wave rectified signal is seen at node 54 and thus also at the non-inverting input pin 3 of differential amplifier circuit 30.

Based on the foregoing, differential amplifier circuit 30 output 32 is a 60 Hz signal when pushbutton 22 is not depressed and a 120 Hz signal when pushbutton 22 is depressed. Output 32 is electrically coupled to pulse counter input 62 of microprocessor 60 whereby the detection of an input signal having a frequency greater than 60 Hz by a predetermined threshold activates audio output 64, thereby supplying an audio signal to amplifier 80 and playing the doorbell ring tones through speaker 90.

Referring now to the operation of pushbutton 24, no appreciable signal is supplied to non-inverting terminal 5 of amplifier circuit 40 when pushbutton 24 remains open, since the voltage at terminal T3 (and thus diode D6) through lamp 26 is pulled low by capacitors C41 and C20. Accordingly, diode D6 does not enter the forward bias region and no signal appears at non-inverting terminal 5, thereby producing no output 42 from differential amplifier circuit 40.

Once pushbutton 24 is depressed diodes D4,D5, D6 and D9 function as a full-wave bridge rectifier to produce a 120 Hz signal at node 56 and thus at non-inverting input terminal 5 of differential amplifier circuit 40. Additionally, a 120 Hz signal is also produced at node 52 and thus coupled to inverting input terminal 6 of differential amplifier circuit 40, which thereby produces a 120 Hz output signal at output 42. Output 42 is electrically coupled to pulse counter input 62 of microprocessor 60. Microprocessor 60, upon detection of a signal at pulse counter input 62 above a predetermined threshold then initiates operation of the door chime via audio output 64, as discussed herein above.

As readily seen by inspection of the bridge rectifier circuit comprising diodes D3, D4, D7 and D8, the orientation of diode 50 is irrelevant to the operation of pushbutton detection circuit 20, since the circuit is operable for either orientation of diode 50. Furthermore, the diode 50 may be placed in parallel with pushbutton 24, and thus in the bridge rectifier circuit comprising diodes D4, D5, D6 and D9, with the only differing result being that amplifier circuit 40 will produce an output signal 42 of 60 Hz when pushbutton 24 is not depressed, and a 120 Hz output when pushbutton 24 is depressed, while amplifier circuit 30 will produce zero output signal 32 when pushbutton 22 is not depressed and a 120 Hz output 32 when pushbutton 22 is depressed.

Furthermore, in an alternative embodiment of the invention, it is possible to employ a plurality of pulse detector inputs 62 coupled to a plurality of pushbutton detection circuits 20 when more than two pushbuttons are required in an application. Additionally, a wide variety of different signal frequencies may be employed in the present invention, since microprocessor 60 may be supplied with suitable programming to activate audio output 64 upon the detection of a signal having a specified frequency. This permits the construction of a doorbell detection circuit 20 having a plurality of pushbuttons, each of which is readily distinguishable from other pushbuttons in the circuit.

In another alternative embodiment of the present invention, microprocessor 60 may include a plurality of audio outputs 64 that are activated responsive to a plurality of different pushbuttons. In the exemplary circuit of FIG. 1 wherein two pushbuttons 22, 24 are employed, microprocessor 60 can readily distinguish which pushbutton is depressed, since the pushbutton 22 that is in parallel with diode 50 produces a 60 Hz signal when the pushbutton is not depressed. Accordingly, where a pulse counter input 62 detects a signal that changes from 60 Hz to 120 Hz, microprocessor 60 may activate an audio output 64 unique to pushbutton 22, thereby providing unique ring tones for differing pushbutton locations.

In a further alternative embodiment of the invention, microprocessor 60 may comprise an accessory output, or a plurality thereof, that is supplied to an accessory indicator to alert a user to the fact that a particular pushbutton 22, 24 has been depressed. The accessory output may be supplied to actuate a vibratory pager, light indicator, strobe, or other indicator device responsive to a pulse counter input detecting a sufficient signal to indicate pushbutton depression.

The foregoing detailed description of the embodiments of the invention is presented primarily for clearness of understanding and no unnecessary limitations are to be understood or implied therefrom. Modifications to the present invention in its various embodiments will become obvious to those skilled in the art upon reading this disclosure and may be made without departing from scope of the invention and the claims appended hereto.

I claim:

1. A doorbell detection and playback circuit for a doorbell pushbutton connected to an alternating current power source comprising:

a bridge rectifier circuit coupled to said power source through a diode placed in parallel with said pushbutton for generating a signal at a first frequency when said pushbutton is not depressed, and generating a signal at a second frequency when said pushbutton is depressed;

a frequency detection circuit coupled to the signal from said bridge rectifier, having an output responsive to the presence of a signal at the second frequency; and an indicator coupled to the output of said frequency detection circuit for generating an indicia of the depression of said pushbutton.

2. The doorbell detection and playback circuit as claimed in claim 1 further comprising an amplifier having an input electrically coupled to the signal from said bridge rectifier and an output coupled to said frequency detection circuit.

3. The doorbell detection and playback circuit as claimed in claim 1 wherein said frequency detection circuit comprises a microprocessor having a pulse counter input for detecting the frequency of a signal coupled thereto.

4. The doorbell detection and playback circuit as claimed in claim 1 further comprising:

a second bridge rectifier circuit coupled to said power source through a second pushbutton for generating a signal at a first frequency when said second pushbutton is not depressed and generating a signal at a second frequency when said second pushbutton is depressed; and a second frequency detection circuit coupled to the signal from said second bridge rectifier having an output responsive to the presence of a signal at said second frequency coupled to said indicator.

5. The doorbell detection and playback circuit as claimed in claim 4 further comprising a second amplifier having an input electrically coupled to the signal from said second bridge rectifier and an output coupled to said second frequency detection circuit.

6. The doorbell detection and playback circuit as claimed in claim 4 wherein said frequency detection circuit comprises a microprocessor having a plurality of pulse counter inputs for detecting the frequency of signals coupled thereto.

7. The doorbell detection and playback circuit as claimed in claim 6 wherein said microprocessor comprises a plurality of audio outputs indicative of doorbell pushbutton depression.

8. The doorbell detection and playback circuit as claimed in claim 7 further comprising an audio amplifier having a plurality of inputs coupled to the audio outputs of said microprocessor, and a plurality of outputs for generating distinct sounds responsive to the depression of first or second pushbuttons.

9. A doorbell detection and playback circuit as claimed in claim 4 wherein said indicator is a light.

10. A doorbell detection and playback circuit as claimed in claim 4 wherein said indicator is a loudspeaker.

* * * * *